US005171163A

United States Patent [19]

McClelland

[11] Patent Number: 5,171,163

[45] Date of Patent: Dec. 15, 1992

[54] ELECTRICAL CABLE CLAMPING DEVICE

[75] Inventor: Tim McClelland, Bolingbrook, Ill.

[73] Assignee: Molex Incorporated, Lisle, Ill.

[21] Appl. No.: 809,358

[22] Filed: Dec. 17, 1991

[51] Int. Cl.[5] ..... H01R 4/24

[52] U.S. Cl. ..... 439/404

[58] Field of Search ..... 439/389–425, 439/492–499

[56] References Cited

U.S. PATENT DOCUMENTS

| | | | |
|---|---|---|---|
| 3,971,616 | 7/1976 | Hashimoto | 439/395 |
| 4,068,912 | 1/1978 | Hudson . | |
| 4,444,447 | 4/1984 | Markwart | 439/409 |
| 4,461,528 | 7/1984 | Durand et al. | 439/409 |
| 4,668,039 | 5/1987 | Marzili . | |
| 4,997,388 | 3/1991 | Dale . | |

OTHER PUBLICATIONS

IS 3246 Mar. 1991 AMP Instruction Sheet.

*Primary Examiner*—Joseph H. McGlynn
*Attorney, Agent, or Firm*—Stephen Z. Weiss

[57] ABSTRACT

A cable clamping device is disclosed for use with an electrical connector for electrically terminating conductors of a multi-conductor flat cable. The cable clamping device includes a pair of clamp members hingedly attached defining mating faces profiled to provide a cable passage therebetween. Complementary interengaging latches on the clamp members hold the members together sandwiching the cable in the passage. A deformable stop is provided on at least one of the clamp members and projecting transversely into the passage for abutting an end of the cable to define a longitudinal position of the cable. The stop is deformable to allow a given cable to extend past the stop out of the passage beyond the clamping device. The clamp members are hingedly attached by a pair of hinge portions on opposite sides of the passage whereby the given cable can pass between the hinge portions beyond the clamping device when the stop is deformed. At least one of the hinge portions is frangible to allow a cable to be inserted edge-wise into the passage. The entire cable clamping device is unitarily molded of dielectric material such as plastic or the like.

16 Claims, 2 Drawing Sheets

ELECTRICAL CABLE CLAMPING DEVICE

FIELD OF THE INVENTION

This invention generally relates to the art of electrical connectors and, particularly, to a cable clamping device for use with an electrical connector for electrically terminating conductors of a multi-conductor flat cable.

BACKGROUND OF THE INVENTION

Electrical connector assemblies are available for multi-conductor flat cables and which include an elongate housing having a cable terminating face. The housing has a plurality of contacts or terminals therein, the contacts having respective conductor receiving portions extending from the mating face, such as insulation displacement conductor terminating portions. The connector assembly also may include an elongate cable clamping cover assembly having latch means engaging complementary latch means on the housing to retain the cover assembly against the cable terminating face of the housing. The cover assembly has a through passage for receiving the conductors and aperture means which receive the conductor receiving portions of the contacts. Such connector assemblies are used, for example, in a communication system wherein it may be desirable to tap a peripheral device into the cable of an existing system. An example of such an electrical connector assembly is shown in U.S. Pat. No. 4,668,039 to Marzili, dated May 26, 1987.

In some instances with electrical connector assemblies of the character described above, it may be desirable to provide a stop means for engaging a distal end of the cable so that the cable does not extend beyond the edge of the cable clamping cover assembly. However, the utilization of such a stop means limits the utility of the connector assembly, in that a different connector assembly or, at least, a different cable clamping cover assembly would have to be provided in those circumstances where it is desirable for the cable to extend entirely through the connector assembly.

This invention is directed to solving those problems by providing a cable clamping device which has deformable or frangible stop means whereby the device can be used either under conditions where it is not desirable for the cable to extend beyond the connector assembly or under conditions wherein the connector assembly is tapped into a cable intermediate the ends thereof.

SUMMARY OF THE INVENTION

An object, therefore, of the invention is to provide a new and improved cable clamping device for use with an electrical connector for electrically terminating conductors of a multi-conductor flat cable.

In the exemplary embodiment of the invention, the cable clamping device includes a pair of clamp members hingedly attached and defining mating faces profiled to define a cable passage therebetween. Complementary interengaging latch means are provided on the clamp members to hold the members together sandwiching the cable in the passage. Deformable or frangible stop means are provided on at least one of the clamp members and projecting transversely of the passage for abutting an end of the cable to define a longitudinal position of the cable. The stop means is deformable or frangible to allow a given cable to extend past the stop means out of the passage beyond the clamping device and the respective electrical connector.

As disclosed herein, the clamp members are hingedly attached along one side of the clamping device by means of at least a pair of hinge portions on opposite sides of the passage, whereby the given cable can pass between the hinge portions beyond the clamping device when the stop means is deformed or broken away.

The cable clamping device is unitarily molded of plastic material and the spaced hinge portions comprise living integral hinges. The hinge portions are sufficiently thin so as to be readily cut to allow a given cable to be inserted into the passage transversely of the longitudinal direction of the passage. The stop means also is unitarily molded so as to be thin enough to be deformable or easily frangible from the clamping device.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
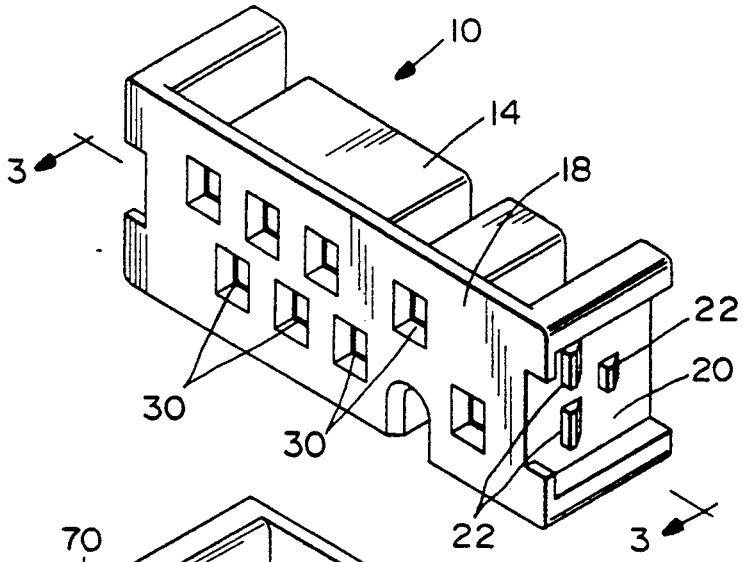
FIG. 1 is a front perspective view of an electrical connector to which the cable clamping device of the invention can be assembled.
Figure 2:
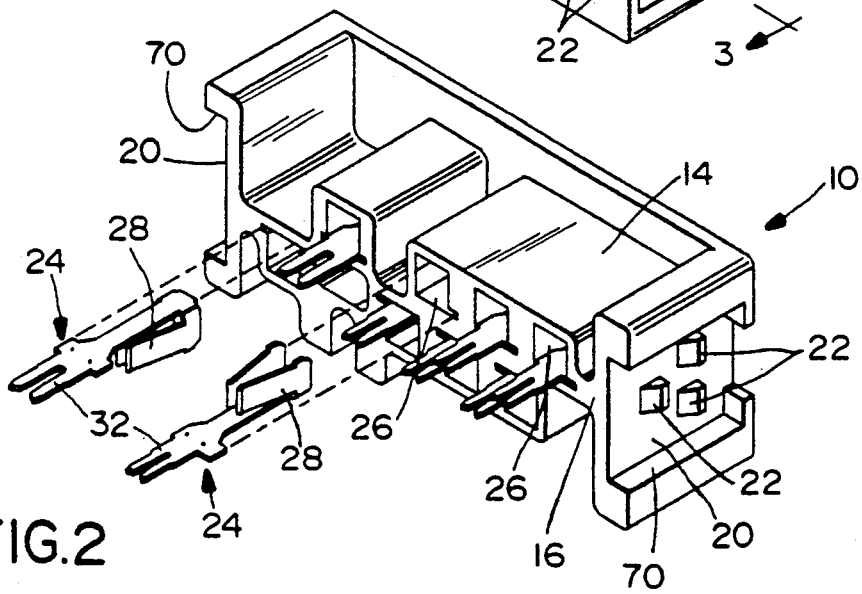
FIG. 2 is a rear perspective view of the cable clamping device of FIG. 1.
Figure 3:
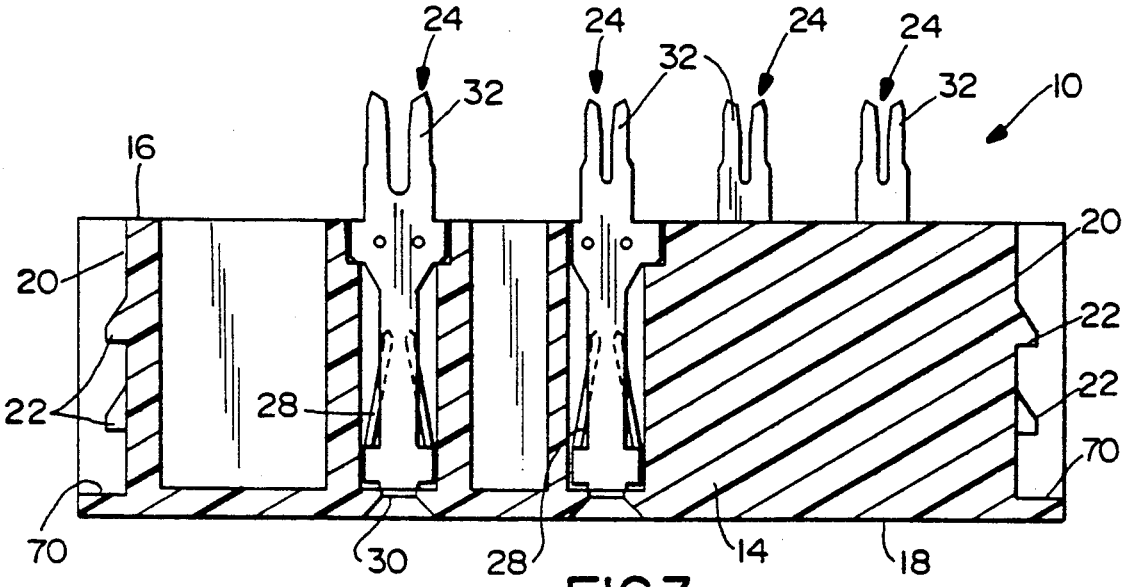
FIG. 3 is a horizontal section taken generally along line 3—3 of FIG. 1.

Referring to the drawings in greater detail, FIGS. 1–3 show an electrical connector, generally designated 10, and FIGS. 4–7 show a cable clamping device, generally designated 12, which when assembled together provide an electrical connector assembly for terminating conductors of a conventional multi-conductor flat cable (not shown). Suffice it to say, a conventional flat multi-conductor cable includes a plurality of generally parallel discrete conductor wires surrounded by insulation and joined by an insulating web.

Turning first to FIGS. 1–3, electrical connector 10 includes an elongate housing 14 having a cable terminating face 16, an opposite mating face 18 and end walls 20 having detent latches 22 projecting outwardly therefrom for assembling cable clamping device 12 to the housing, as described hereinafter.

A plurality of terminals 24 are mounted in through passages 26 in housing 14. Each terminal 24 has a mating contact end 28 located behind openings 30 in mating face 18 for receiving complementary contacts from an appropriate mating connector. As shown, each contact portion 28 is a female receptacle for receiving a complementary pin contact from the mating connector. Each terminal 24 also has a terminating portion 32 at an end thereof opposite contact portion 28. As shown, the terminating portion is bifurcated to provide an insulation displacement means for terminating a respective conductor wire of the flat multi-conductor cable by piercing the insulation of the cable, as is known in the art. The termination portions 32 of terminals 24 project rearwardly from cable terminating face 16 of housing 14 of electrical connector 10, as best seen in FIGS. 2 and 3.

Referring to FIGS. 4–7, cable clamping device 12, according to the invention, includes a pair of clamp members, generally designated 40 and 42, which are hingedly attached and define mating faces 40*a* and 42*a*, respectively. Recessed areas 44 and 46 in mating face 40*a* of clamp member 40, and recessed areas 48 and 50 in mating face 42*a* of clamp member 42 combine, when the clamp members are closed in the direction of arrows "A" (FIG. 4), to define a cable receiving passage means between the closed clamp members.

Figure 4:
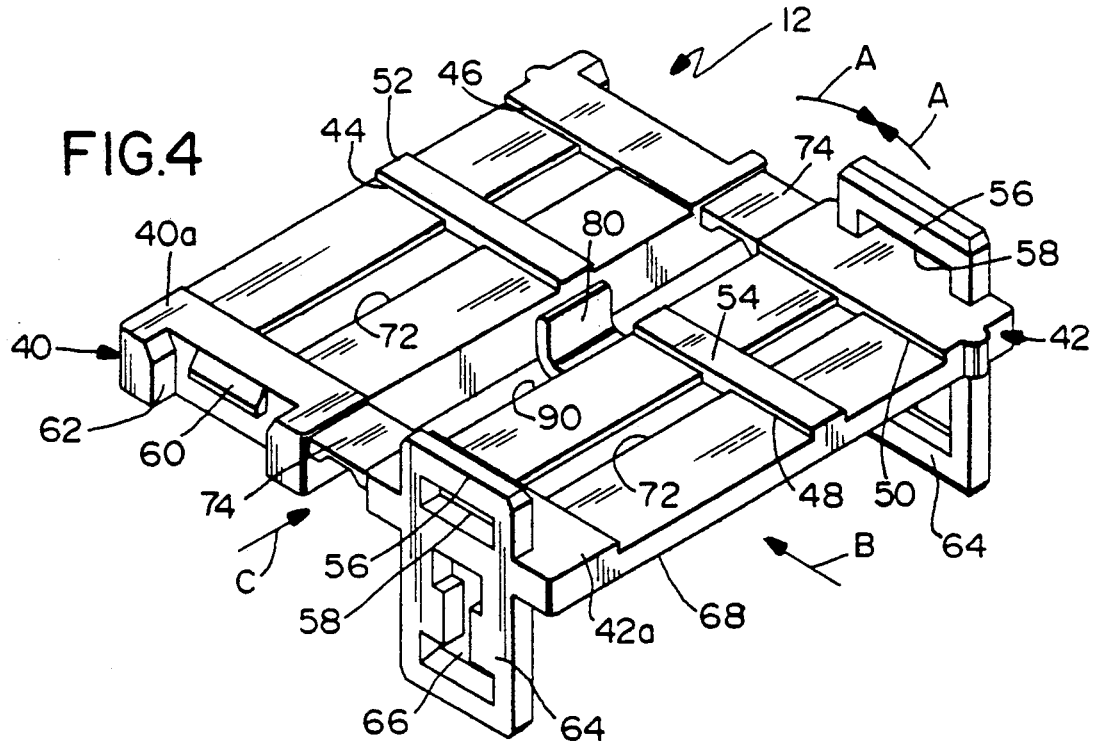
FIG. 4 is a perspective view of the cable clamping device of the invention.

For instance, in the communications industry, a multi-conductor flat cable may include power conductors separated transversely of the cable from data conductors and all of the conductors joined by the insulating web of the cable. The data conductors would be disposed in the through passage means defined by recessed areas 44 and 48 of clamp members 40 and 42, respectively, and the power conductors would be disposed in the through passage means defined by recessed areas 46 and 50 of clamp members 40 and 42, respectively. Recessed areas 40 and 46 of clamp member 40 are divided by a raised rib 52, and recessed areas 48 and 50 of clamp member 42 are divided by a raised rib 54, all of which is best seen in FIG. 4. When clamp members 40 and 42 are closed in the direction of arrows "A", ribs 52 and 54 clamp onto the web of insulation of the multi-conductor flat cable which separates the power conductor grouping from the data conductor grouping.

Latch means are provided on clamp members 40 and 42 to hold the members together sandwiching the flat cable therebetween in the through passage means defined by recessed areas 44, 46, 48 and 50. More particularly, latch arms 56, having elongate apertures 58, project from each side of clamp member 42. Latch detents 60 are located in recessed areas 62 on each side of clamp member 40. The latch detents have tapered camming surfaces which will engage latch arms 56 when the clamp members are closed. When the clamp members are in fully closed condition, clamping the multi-conductor flat cable therebetween, latch arms 56 snap over latch detents 60 as the latch detents snap into apertures 58 in the latch arms.

Cable clamping device 12 also includes latch means for assembling the device to electrical connector 10 (FIGS. 1–3). More particularly, second latch arms 64, having aperture means 66, project from clamp member 42, from a face 68 thereof opposite mating face 42*a*. As best seen in FIG. 2, end walls 20 of housing 14 of electrical connector 10 include slots 70 opening in terminating face 16 at the rear of the housing. In assembling cable clamping device 12 to electrical connector 10, latch arms 64 slide into slots 70 from the rear of the electrical connector until detents latches 22 snap into aperture means 66 in the latch arms. It can be seen that three detent latches 22 are provided on each end wall 20 of housing 14 within each slot 70. The singular rearmost detent latch of each array snaps into aperture means 66 of latch arms 64 to provide a "preassembled" condition of the clamping device on the electrical connector. The pre-assembled clamping device and electrical connector can be shipped and handled together in this condition without the presence of a multi-conductor flat cable. At any time, such as in the field, the cable can be inserted into the assembly as described hereinafter, and the cable clamping device can be forced against cable terminating face 16 of the electrical connector to force insulation displacement portions 32 of terminals 24 through the insulation of the cable and terminate the conductors therein. To this end, and referring back to FIG. 4, elongated openings or slots 72 are provided in clamp members 40 and 42, in a direction transverse of the elongated direction of the cable, through which insulation displacement portions 32 of the terminals can project.

As this point, it should be noted that cable clamping device 12 is unitarily molded of dielectric material such as plastic or the like and including latch arms 56 and 64 projecting from opposite faces of clamp member 42. Therefore, the latch arms are flexible for snapping over latch detents 60 on clamp member 40 and detent latches 22 on electrical connector 10.

As stated above, clamp members 40 and 42 are hingedly attached for clamping movement toward each other in the direction of arrows "A" (FIG. 4). With the clamping device being unitarily molded of plastic material, hinge means are provided by integral living hinge portions 74 joining the clamp members. As seen in FIG. 4, the hinge portions are spaced apart and located outside recessed areas 44–50 which define the passage means for the cable.

Figure 6:
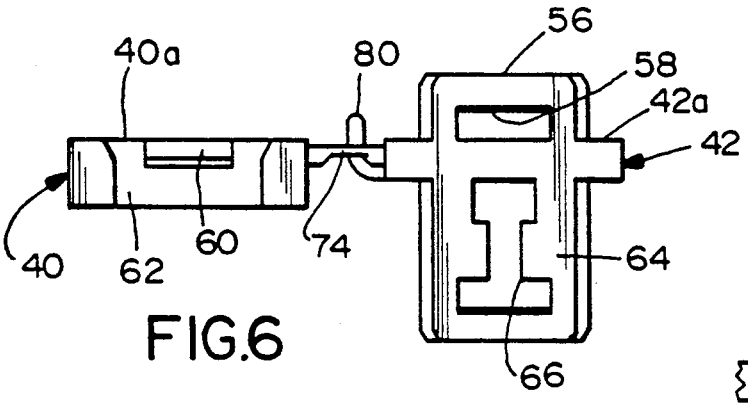
FIG. 6 is a side elevational view looking generally toward the left-hand side of FIG. 4; and means of the cable clamping device.
Figure 7:
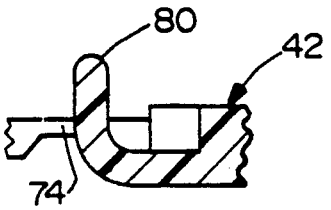
FIG. 7 is a fragmented section through the stop means of the cable clamping device.

The invention contemplates a unique deformable or frangible stop means on at least one of clamp members 40 and/or 42 and projecting transversely of the cable passage for abutting an end of the cable to define a longitudinal position of the cable. Referring to FIGS. 6 and 7 in conjunction with FIG. 4, this stop means is provided by a unitarily molded stop tab 80 projecting inwardly beyond mating face 42*a* of clamp member 40, i.e. in the path of movement of a flat cable, as indicated by arrow "B" (FIG. 4). When the cable is either laid into clamp member 42 or inserted into partially closed clamp members 40 and 42, the end of the cable can be moved into abutment with stop tab 80 to define the proper longitudinal position of the cable within the clamping device when the clamp members ultimately are closed and latched.

Figure 5:
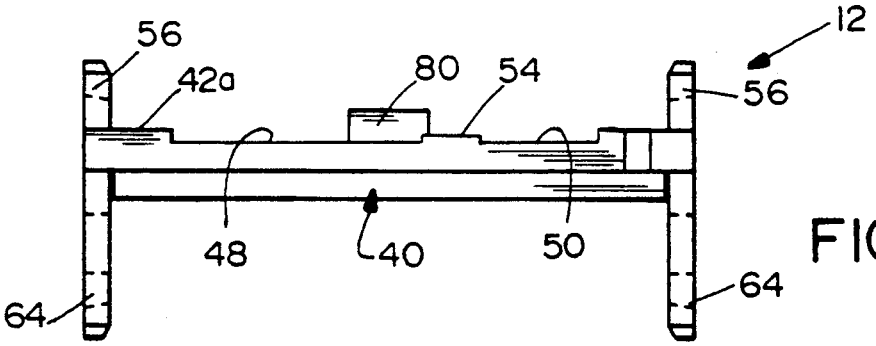
FIG. 5 is a front elevational view of the cable clamping device, looking generally toward the right-hand side of FIG. 4.

The invention contemplates that stop tab 80 be of a size and configuration so as to be deformable or fully frangible in order for the clamping device to be threaded onto the end of a flat cable to thereby allow a given cable to extend past the stop tab out of the passage means and beyond the clamping device. As an example, in an actual clamping device, the thickness of stop tab 80 as viewed in FIG. 7 may be on the order of 0.04 inch of plastic material. The width of the stop tab as seen in FIG. 5 may be on the order of 0.19 inch of plastic material. This would allow the tab to be deformed or completely broken away from clamp member 42 and allow the end of a given multi-conductor flat cable to extend completely through the clamping device when the clamping device is completely closed. Therefore, as used herein and in the claims hereof, the broader term "deformable" is intended to include a "frangible" stop means.

The invention also contemplates that clamping device 12 can be utilized for positioning onto a flat cable, transversely thereof, in order to tap into the cable a distance from the end of the cable which would make it impractical to thread the cable through the clamping device. More particularly, as best in FIG. 6, each living hinge portion 74 is made quite thin in the center area thereof, such as on the order of 0.02 inch of plastic material, whereby either hinge portion can be readily broken or cut to slide a longitudinal edge of a flat cable between clamp members 40 and 42 when partially closed. The cable would slide in the direction of arrow "C" (FIG. 4) into a spacing 90 between the clamp members.

In view of the foregoing, it can be seen that by fabricating cable clamping device 12 so that both stop tab 80 and living hinge portions 74 are sufficiently thin and of plastic material, the stop tab can be deformed or completely broken away, and the living hinge portions can be broken or cut, to accommodate a multi-conductor flat cable into the clamping device in three different modes, namely: (1) inserting an end of the cable into the clamping device until the end of the cable abuts stop tab 80, (2) similarly inserting the cable into the clamping device, but deforming or breaking-away the stop tab to allow the cable to project a distance through the clamping device, or (3) tapping the clamping device edgewise onto the cable a substantial distance from its end by simply severing one of the living hinge portions 74.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a cable clamping device for use with an electrical connector for electrically terminating conductors of a multi-conductor flat cable, wherein the cable attached and defining mating faces profiled to provide a cable passage therebetween and complementary interengaging latch means on the clamp members to hold the members together sandwiching the cable in the passage, the improvement comprising deformable stop means on at least one of the clamp members and projecting transversely of the passage for abutting an end of the cable to define a longitudinal position of the cable, the stop means being deformable to allow a given cable to extend past the stop means out of the passage beyond the clamping device.

2. In a cable clamping device as set forth in claim 1, wherein said at least one clamp member, including said stop means, is unitarily molded of plastic material with at least part of the stop means being thin enough to be deformable.

3. In a cable clamping device as set forth in claim 1, wherein said clamp members are hingedly attached by means of at least a pair of hinge portions on opposite sides of the passage whereby said given cable can pass between the hinge portions beyond the clamping device when the stop means is deformed.

4. In a cable clamping device as set forth in claim 3, wherein said clamping device is unitarily molded of plastic material and said hinge portions comprise living integral hinges thereof.

5. In a cable clamping device as set forth in claim 3, wherein said latch means are located on at least one end of the device remote from the hinged attachment of the clamp members.

6. In a cable clamping device as set forth in claim 1, wherein said clamp members are hingedly attached by means of at least a pair of hinge portions on opposite sides of the passage, at least one of the hinge portions being frangible to allow a given cable to be inserted edgewise into the passage.

7. In a cable clamping device as set forth in claim 6, wherein said clamping device is unitarily molded of plastic material and said at least one hinge portion comprises a living integral hinge which is thin enough to be frangible.

8. In a cable clamping device for use with an electrical connector for electrically terminating conductors of a multi-conductor flat cable, wherein the cable clamping device includes a pair of clamp members defining mating faces profiled to provide a cable passage therebetween and complementary interengaging latch means on the clamp members to hold the members together sandwiching the cable in the passage, the improvement comprising deformable stop means on at least one of the clamp members and projecting transversely of the passage for abutting an end of the cable to define a longitudinal position of the cable, the stop means being deformable to allow a given cable to extend past the stop means out of the passage beyond the clamping device.

9. In a cable clamping device as set forth in claim 8, wherein said latch means are located on at least one end of the device remote from the hinged attachment of the clamp members.

10. In a cable clamping device as set forth in claim 8, wherein said at least one clamp member, including said stop means, is unitarily molded of plastic material with at least part of the stop means being thin enough to be deformable.

11. An electrical connector assembly for terminating a multi-conductor flat cable, comprising:

an electrical connector electrically terminating conductors of the multi-conductor flat cable and including latch means thereon;

a cable clamping device including a pair of clamp members hingedly attached by a pair of spaced hinge portions, the clamp members defining mating faces profiled to provide a cable passage therebetween and with complementary interengaging latches on the clamp members to hold the members together sandwiching the cable in the passage, deformable stop means on at least one of the clamp members and projecting transversely of the passage for abutting an end of the cable to define a longitudinal position of the cable, the stop means being deformable to allow a given cable to extend past the stop means out of the passage beyond the clamping device, the spaced hinge portions being disposed on opposite sides of the passage whereby said given cable can pass between the hinge portions beyond the clamping device when the stop means is deformed, and latch means complementary to the latch means on the electrical connector for assembling the cable clamping device to the connector.

12. In a cable clamping device as set forth in claim 11, wherein said clamping device is unitarily molded of plastic material and said hinge portions comprise living integral hinges thereof.

13. In a cable clamping device as set forth in claim 11, wherein said latches are located on at least one end of the device remote from the hinged attachment of the clamp members.

14. In a cable clamping device as set forth in claim 11, wherein said at least one clamp member, including said stop means, is unitarily molded of plastic material with at least part of the stop means being thin enough to be deformable.

15. In a cable clamping device as set forth in claim 11, wherein at least one of the hinge portions is frangible to allow a given cable to be inserted edge-wise into the passage.

16. In a cable clamping device as set forth in claim 15, wherein said clamping device is unitarily molded of plastic material and said at least one hinge portion comprises a living integral hinge which is thin enough to be frangible.

* * * * *